US006965321B1

(12) United States Patent
Arab

(10) Patent No.: US 6,965,321 B1
(45) Date of Patent: Nov. 15, 2005

(54) VEHICLE NOTIFICATION SYSTEM

(76) Inventor: Abbas Arab, 61 Catts Private, Ottawa, Ontario (CA) K1T 2X7

( * ) Notice: Subject to any disclaimer, the term of this patent is extended or adjusted under 35 U.S.C. 154(b) by 1 day.

(21) Appl. No.: 10/657,347

(22) Filed: Sep. 9, 2003

(51) Int. Cl.[7] ..... G08G 1/00
(52) U.S. Cl. ..... 340/901; 340/693.6; 340/693.9
(58) Field of Search ..... 340/901–905, 340/693.6, 693.9; 701/117

(56) References Cited

U.S. PATENT DOCUMENTS 4,591,823 A * 5/1986 Horvat ..... 340/936
D344,243 S 2/1994 Peraino et al.
5,495,243 A 2/1996 McKenna
5,572,201 A * 11/1996 Graham et al. ..... 340/902
5,594,432 A 1/1997 Oliva et al.
5,635,920 A 6/1997 Pogue et al.
5,734,336 A * 3/1998 Smithline ..... 340/901
5,841,367 A 11/1998 Giovanni
6,011,492 A 1/2000 Garesche
6,160,493 A * 12/2000 Smith ..... 340/902
6,356,210 B1 * 3/2002 Ellis ..... 340/990
6,690,291 B1 * 2/2004 Cardillo et al. ..... 340/901
6,891,480 B2 * 5/2005 Williams et al. ..... 340/693.6
2003/0016143 A1 * 1/2003 Ghazarian ..... 340/901
2004/0233045 A1 * 11/2004 Mays ..... 340/425.5

* cited by examiner

*Primary Examiner*—Jeffery Hofsass
*Assistant Examiner*—Anne V. Lai

(57) ABSTRACT

A vehicle notification system includes a control panel removably positionable inside a vehicle and including a transceiving mechanism for identifying imminent environmental conditions. The system further includes a plurality of transceivers disposed at predetermined locations exterior of a vehicle housing the control panel. The plurality of transceivers selectively send a plurality of input signals to the transceiving mechanism and for identifying an imminent environmental condition, respectively. The transceiving mechanism includes a display panel housed by the control panel for providing visual information regarding an imminent environmental condition. The transceiving mechanism may further include an input mechanism connected to the control panel for receiving driver-identification information so that one of the plurality of transceivers can identify a driver of a vehicle.

18 Claims, 4 Drawing Sheets

VEHICLE NOTIFICATION SYSTEM

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a vehicle notification system and, more particularly, to a vehicle notification system for automatically warning a driver of potential dangers while driving.

2. Prior Art

Various systems have been proposed to inform motorists of traffic hazards. Some systems use modulated carrier signals to convey traffic information. Unfortunately, many modern vehicle passenger compartments are designed and built to be quiet when their windows are closed. Outside noises coming from car horns and radios are prevented from entering the passenger compartment and distracting the driver. Unfortunately, emergency vehicle sirens and train whistles are also prevented from entering the passenger compartment. Car radios or sound systems played at moderate levels inside the vehicle make it even more difficult to hear outside alarms. Thus, an emergency vehicle siren or a train whistle may be undetected by the occupants of a vehicle. This creates a hazardous situation on the highways.

Emergency vehicles need an unobstructed path to respond to an emergency within an acceptable time frame. The occupants of the emergency vehicle need to be able to change traffic signals and alert the drivers of other vehicles to the presence of the emergency vehicle. In the past, radio frequency energy has been used to alert the occupants of one vehicle to the presence of another vehicle. Radio frequency signals were transmitted from one vehicle and detected by an unsuspecting second vehicle. Upon detection, a warning signal was generated in the second vehicle.

In a rural area, where few emergencies occur and few trains travel, an occasional interruption by a train or emergency vehicle alarm signal may be acceptable. However, in a city or suburban environment, emergencies occur more frequently. Constant interruption of the radio and subsequent distraction of the driver due to an emergency occurring many blocks away may create a hazard. Thus, a signal limited in range by objects in its path is desired. It is also desirable to change traffic signals in the immediate vicinity of the emergency vehicle.

To be useful in cities and suburbs, the energy transmitted by the emergency vehicle's alarm system must be limited to the immediate vicinity. The system should regulate traffic flow by changing traffic signals and alerting the drivers of vehicles to the presence of an emergency vehicle.

BRIEF SUMMARY OF THE INVENTION

In view of the foregoing background, it is therefore an object of the present invention to provide a vehicle notification system for automatically warning a motorist of potential dangers while driving. These and other objects, features, and advantages of the invention are provided by a system including a control panel removably positionable inside a vehicle and including a transceiving mechanism for identifying imminent environmental conditions. The transceiving mechanism includes a display panel housed by the control panel for providing visual information regarding an imminent environmental condition. The transceiving mechanism may further include an input mechanism connected to the control panel for receiving driver-identification information so that one of the plurality of transceivers can identify a driver of a vehicle.

The system further includes a plurality of transceivers disposed at predetermined locations exterior of a vehicle housing the control panel. The plurality of transceivers selectively send a plurality of input signals to the transceiving mechanism and for identifying an imminent environmental condition, respectively. A mounting bracket connects the control panel to a vehicle and a speaker connected to the control panel provides audible identification of an imminent environmental condition.

The transceiving mechanism may further include a sensor connected to the display panel for housing the transceiving mechanism. The control panel may further include a mechanism for calculating a vehicle speed and distance from one of the plurality of transceivers so that a vehicle can be notified whether or not to proceed beyond such a transceiver. The display panel may be a LCD and the input mechanism may include a keypad. In a preferred embodiment, the system may include a mechanism for reading a personal identification card so that an identity of a person may be recognized by said system and transmitted to a remote location.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

Figure 1:
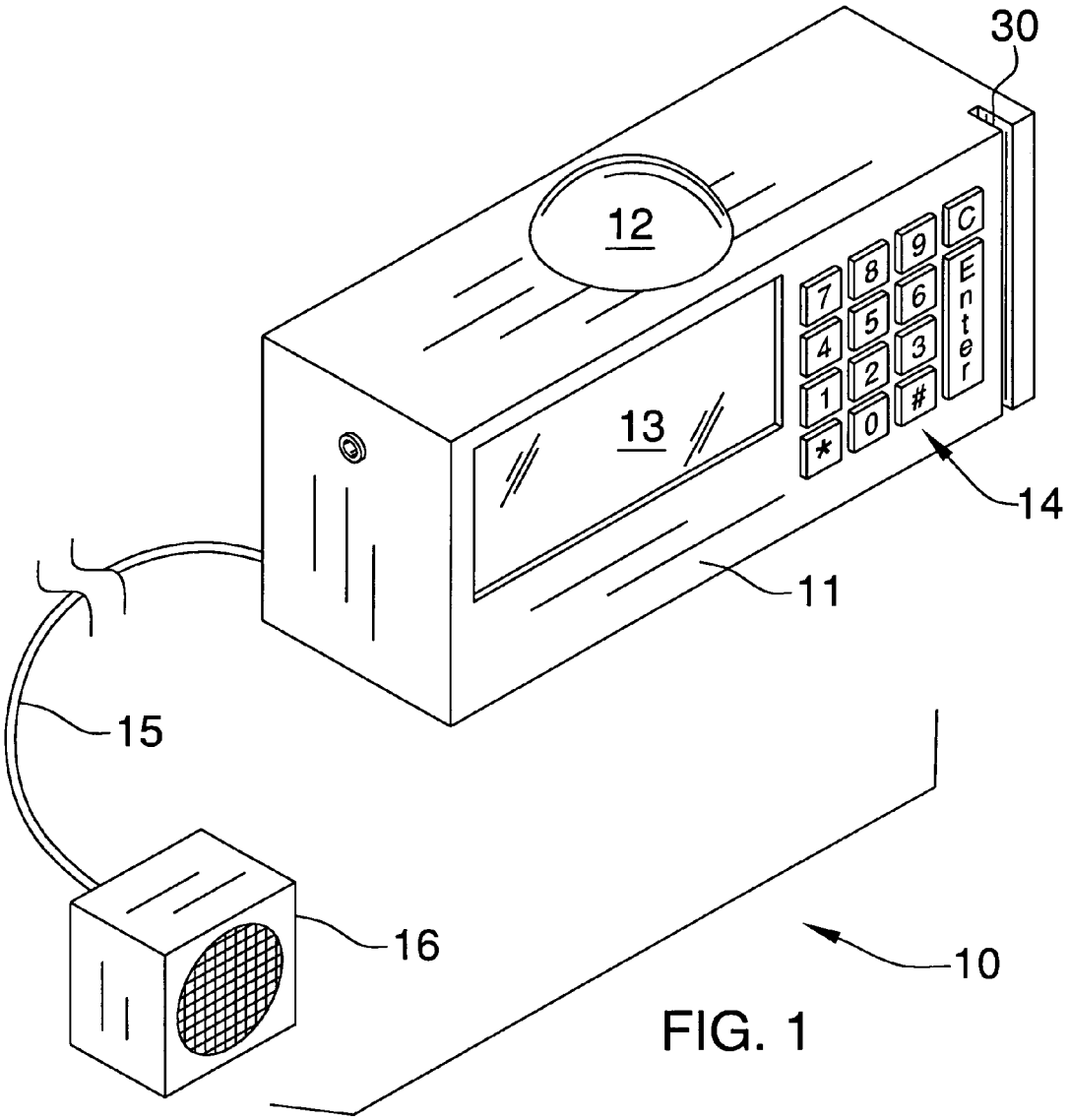
FIG. 1 is a perspective view showing a vehicle notification system, in accordance with the present invention.

The system of this invention is referred to generally in FIG. 1 by the reference numeral 10 and is intended to provide a vehicle notification system for warning a driver when a hazardous condition is imminent. It should be understood that the system 10 may be employed by various vehicles and, therefore, should not be construed as limited to land vehicles.

The system 10 includes a control panel 11 including a sensor 12 connected to a top surface thereof. A display panel 13 is positioned at a front face of the control panel 11 and is preferably a LCD. The control panel 11 is programmed to communicate with the display panel 13 based upon input signals received from outside of the vehicle. Such a display panel 13 provides important information to a driver of the vehicle during operating conditions. For example, the display panel 13 can provide text messages as well as images of traffic lights, stop signs and other typical roadside signs to that the driver will know in advance when to slow down or stop. The display screen 13 also displays location and date information such as the city, state, time, and highway.

The system 10 further includes a mechanism 30 for reading a personal identification card so that an identity of a person may be recognized by the system 10 and transmitted to a remote location such as a police vehicle, for example. An input panel 14 is also positioned on the front face of the control panel 11. Such an input panel 14 is preferably a keypad wherein a driver can enter a personal identification number (PIN) to alert others such as the police, for example, of the driver's identity. Such a PIN may also be used to identify whether the driver has a criminal history arrests or DUI convictions. A speaker 16 is connected to the control panel 11 via a conventional wire 15 and for providing audible signals to the driver, which correspond to the environmental conditions identified by the sensor 12.

Figure 5:
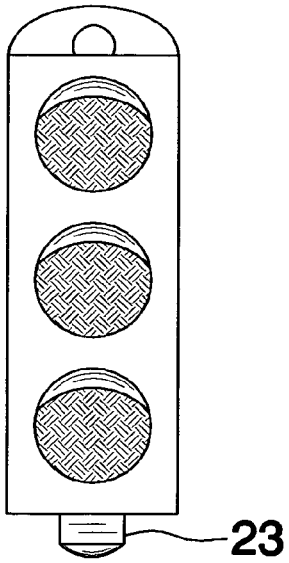
FIG. 5 is a front view showing a transmitter attached to a traffic light for communicating with the present invention shown in FIG. 4.
Figure 6:
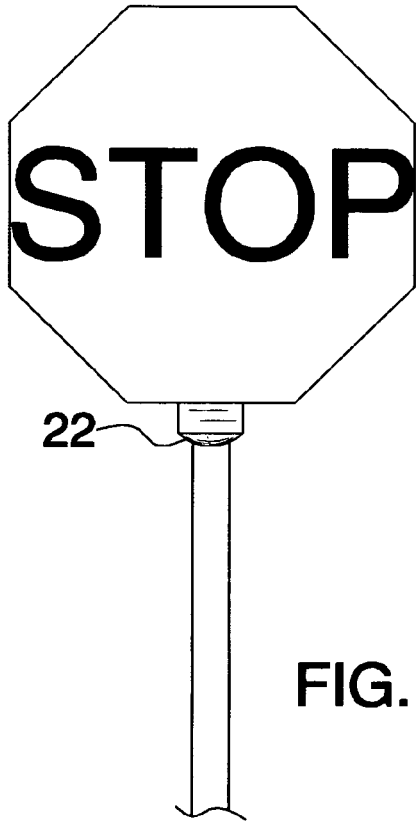
FIG. 6 is a front view showing a transmitter attached to a stop sign for communicating with the present invention shown in FIG. 4.

A plurality of transceivers are positioned at predetermined strategic locations such as at stop signs and traffic lights, for example, as best shown in FIGS. 5 and 6. Of course, the plurality of transceivers may be positioned at many different locations such as intersections, as determined by a state or local agencies, for example.

Figure 2:
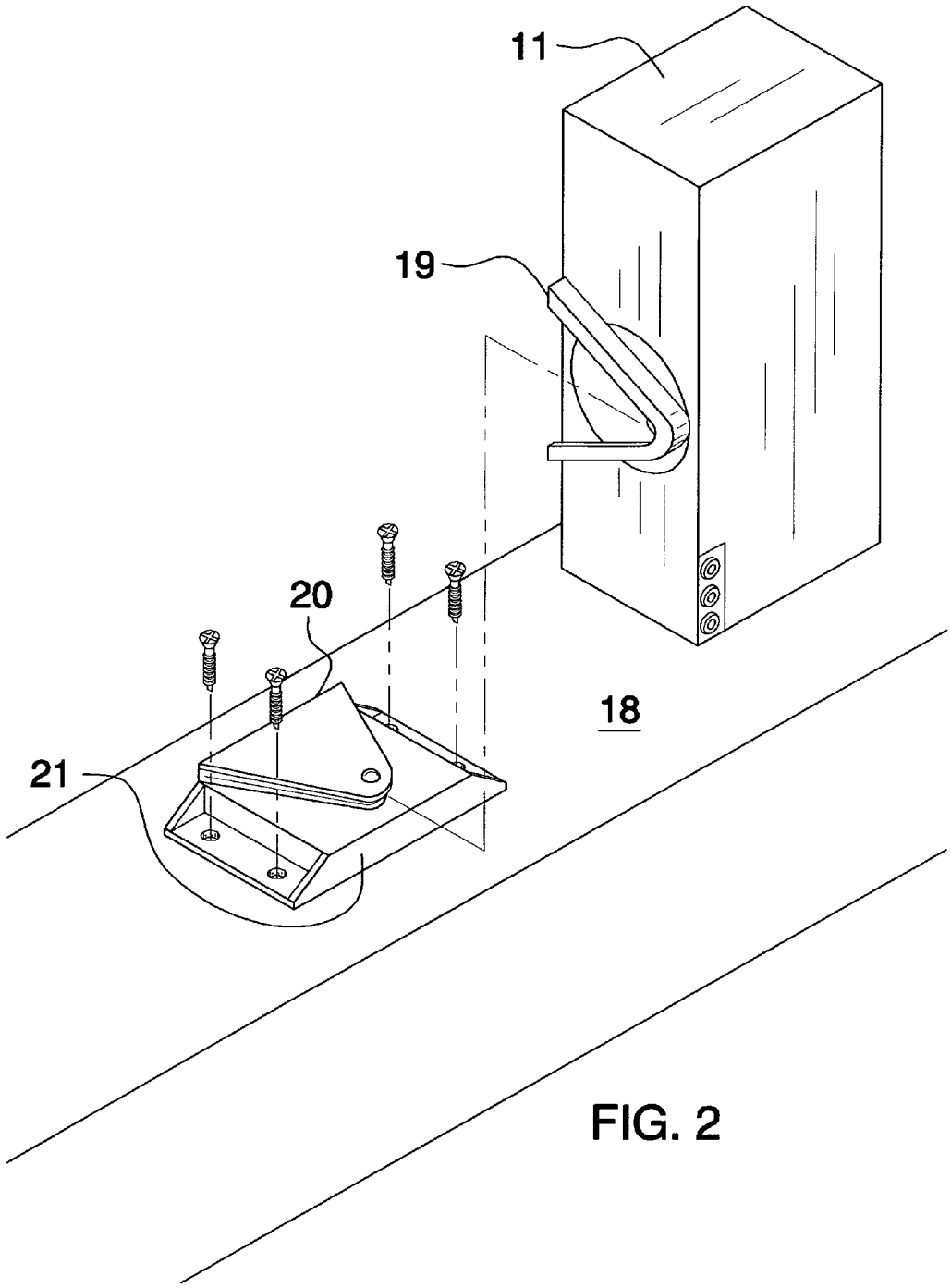
FIG. 2 is an exploded, perspective view of the mounting bracket employed by the system shown in FIG. 1.
Figure 4:
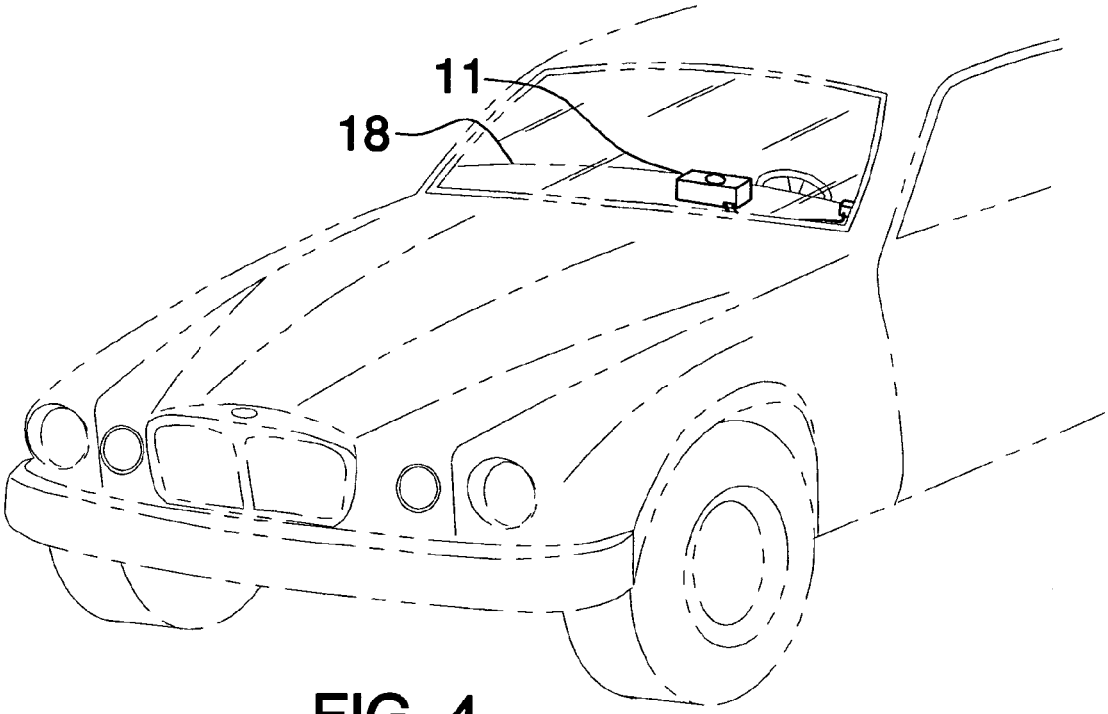
FIG. 4 is a perspective view showing the present invention mounted in a vehicle.

Now referring to FIGS. 2 and 4, the system 10 is preferably attached to an interior of a vehicle 18. In particular, a mounting bracket 21 includes a substantially planar bottom surface for connecting to a dashboard of vehicle 18 via a plurality of fastening members. A plurality of holes are formed at opposed corner portions of the mounting bracket 21 for receiving such fastening members therethrough. A substantially pyramid-shaped receiving member 20 is formed at a top surface of the bracket 21 and selectively receives a substantially pyramid-shaped male member 19 thereacross for attaching the control panel 11 to the mounting bracket 21. The male member 19 is connected to a bottom surface of the control panel 11 and may be removably fastened to the female member 20 via a conventional fastener.

Figure 3:
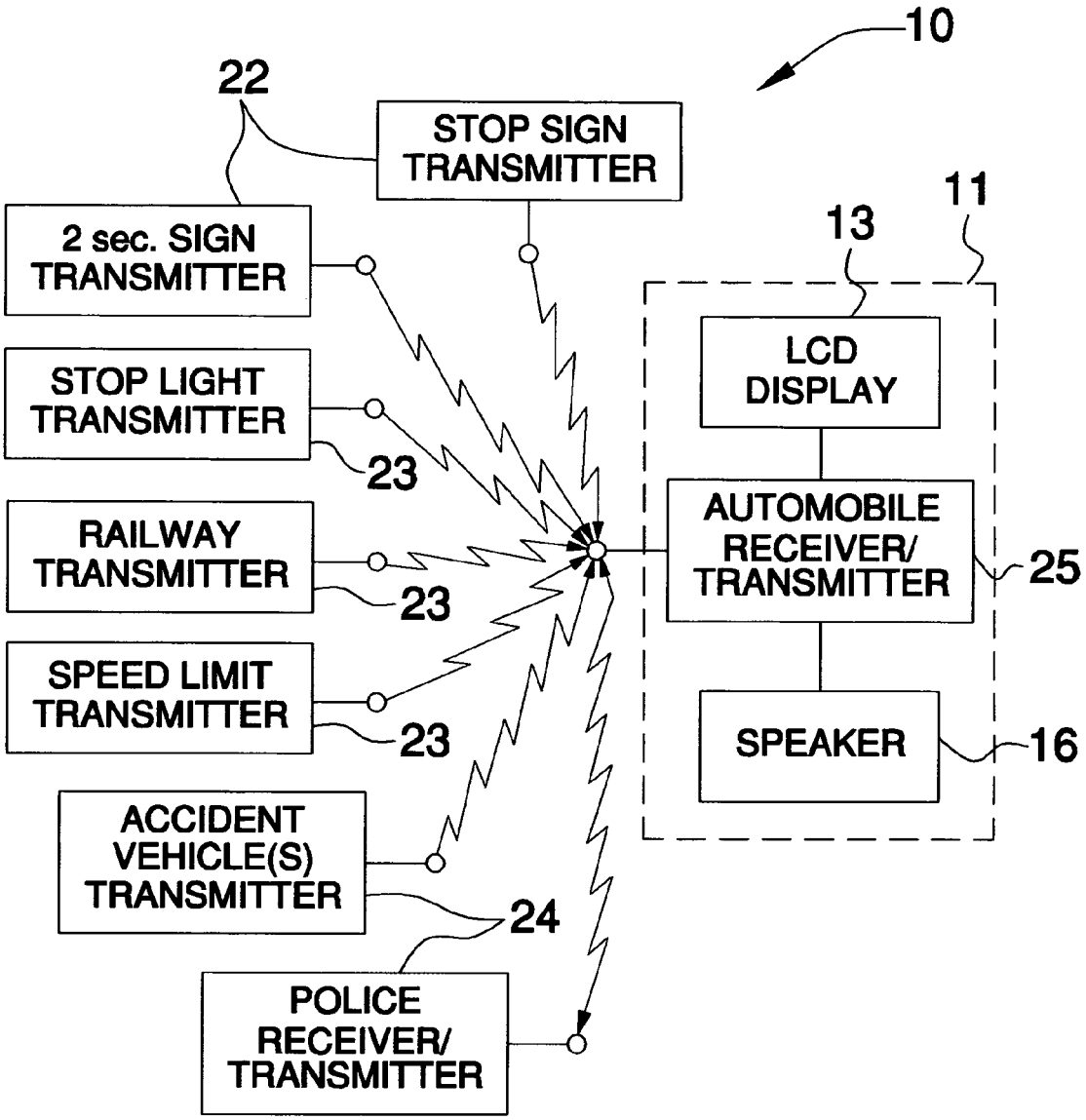
FIG. 3 is a schematic diagram showing the environmental operating logistics of the present invention.

Now referring to FIG. 3, a schematic diagram of the present invention 10 is shown wherein the display panel 13, transceiver 25 and speaker 16 operate in a shared environment, while the plurality of transceivers 22–24 operate in separate environments, respectively. In particular, such transceivers 22–24 selectively transmit signals, which identify the environmental conditions or hazards in the vicinity of their locations. Such signals are received by a transceiver 25 housed within the control panel 11.

The transceiver 25 processes the signals and communicates with the display panel 13 and speaker 16 for alerting the driver of the detected environmental conditions, which have been sent via the plurality of transceivers 22–24. Of course, one of such transceivers may be positioned in a police car for alerting the driver of potential hazards nearby.

The control panel 11 is programmed for calculating the speed of the driver's vehicle and the distance of the identified environmental condition, for notifying the driver whether they have sufficient time to continue beyond the hazardous area or whether they should take a detour before reaching the area. Police cars that are equipped with transceivers 24 may also signal drivers to pull over if they have committed a violation or may warn drivers to stay away from downed power lines, crime scenes, and other potential dangers. Of course, the present invention may employ more than the three transceivers shown in FIG. 3.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A system for notifying a driver of a vehicle of imminent environmental conditions, said system comprising:

a control panel removably positionable inside a vehicle and including transceiving means for identifying imminent environmental conditions, said control panel further including a male member having a substantially pyramid shape, said male member being directly connected to a bottom surface of said control panel;

a plurality of transceivers disposed at predetermined locations exterior of a vehicle housing said control panel, said plurality of transceivers selectively sending a plurality of input signals to said transceiving means and for identifying an imminent environmental condition, respectively;

a mounting bracket for connecting said control panel to a vehicle, said mounting bracket including a base plate having planar top and bottom surfaces, said top surface having a surface area less than a surface area of said bottom surface, said mounting bracket further including a female receiving member having a substantially pyramid shape, said female receiving member being directly conjoined to said top surface of said base plate; and wherein a user selectively inserts said male member into said female receiving member such that said control panel can be removably attached to said mounting bracket;

a speaker connected to said control panel and for providing audible identification of an imminent environmental condition.

2. The system of claim 1, wherein said transceiving means comprises a display panel housed by said control panel and for providing visual information regarding an imminent environmental condition.

3. The system of claim 2, wherein said display panel comprises an LCD.

4. The system of claim 1, wherein said transceiving means further comprises a sensor connected to said display panel and for housing said transceiving means.

5. The system of claim 1, wherein said transceiving means further comprises input means connected to said control panel for receiving driver-identification information so that one of said plurality of transceivers can identify a driver of a vehicle.

6. The system of claim 1, wherein said control panel further comprises means for calculating a vehicle speed and distance from one of said plurality of transceivers so that a vehicle can be notified whether or not to proceed beyond said one plurality of transceivers.

7. The system of claim 1, further comprising means for reading a personal identification card so that an identity of a person may be recognized by said system and transmitted to a remote location.

8. A system for notifying a driver of a vehicle of imminent environmental conditions, said system comprising:

a control panel removably positionable inside a vehicle and including transceiving means for identifying imminent environmental conditions, said transceiving means including a display panel housed by said control panel and for providing visual information regarding an imminent environmental condition, said control panel further including a male member having a substantially pyramid shape, said male member being directly connected to a bottom surface of said control panel;

a plurality of transceivers disposed at predetermined locations exterior of a vehicle housing said control panel, said plurality of transceivers selectively sending a plurality of input signals to said transceiving means and for identifying an imminent environmental condition, respectively;

a mounting bracket for connecting said control panel to a vehicle, said mounting bracket including a base plate having planar top and bottom surfaces, said top surface having a surface area less than a surface area of said bottom surface, said mounting bracket further including a female receiving member having a substantially pyramid shape, said female receiving member being directly conjoined to said top surface of said base plate; and wherein a user selectively inserts said male member into said female receiving member such that said control panel can be removably attached to said mounting bracket;

a speaker connected to said control panel and for providing audible identification of an imminent environmental condition.

9. The system of claim 8, wherein said transceiving means further comprises a sensor connected to said display panel and for housing said transceiving means.

10. The system of claim 8, wherein said transceiving means further comprises input means connected to said control panel for receiving driver-identification information so that one of said plurality of transceivers can identify a driver of a vehicle.

11. The system of claim 8, wherein said control panel further comprises means for calculating a vehicle speed and distance from one of said plurality of transceivers so that a vehicle can be notified whether or not to proceed beyond said one plurality of transceivers.

12. The system of claim 8, wherein said display panel comprises an LCD.

13. The system of claim 8, further comprising means for reading a personal identification card so that an identity of a person may be recognized by said system and transmitted to a remote location.

14. A system for notifying a driver of a vehicle of imminent environmental conditions, said system comprising:

a control panel removably positionable inside a vehicle and including transceiving means for identifying imminent environmental conditions, said control panel further including a male member having a substantially pyramid shape, said male member being directly connected to a bottom surface of said control panel, said transceiving means including a display panel housed by said control panel and for providing visual information regarding an imminent environmental condition, said transceiving means further including input means connected to said control panel for receiving driver-identification information so that one of said plurality of transceivers can identify a driver of a vehicle;

a plurality of transceivers disposed at predetermined locations exterior of a vehicle housing said control panel, said plurality of transceivers selectively sending a plurality of input signals to said transceiving means and for identifying an imminent environmental condition, respectively;

a mounting bracket for connecting said control panel to a vehicle, said mounting bracket including a base plate having planar top and bottom surfaces, said top surface having a surface area less than a surface area of said bottom surface, said mounting bracket further including a female receiving member having a substantially pyramid shape, said female receiving member being directly conjoined to said top surface of said base plate; and wherein a user selectively inserts said male member into said female receiving member such that said control panel can be removably attached to said mounting bracket;

a speaker connected to said control panel and for providing audible identification of an imminent environmental condition.

15. The system of claim 14, wherein said transceiving means further comprises a sensor connected to said display panel and for housing said transceiving means.

16. The system of claim 14, wherein said control panel further comprises means for calculating a vehicle speed and distance from one of said plurality of transceivers so that a vehicle can be notified whether or not to proceed beyond said one plurality of transceivers.

17. The system of claim 14, wherein said display panel comprises an LCD.

18. The system of claim 14, further comprising means for reading a personal identification card so that an identity of a person may be recognized by said system and transmitted to a remote location.

* * * * *